US007882599B2

(12) United States Patent
Harrington

(10) Patent No.: US 7,882,599 B2
(45) Date of Patent: Feb. 8, 2011

(54) HANDCUFF APPARATUS

(76) Inventor: Robert Harrington, 20B Westside Dr., Ashville, NC (US) 28806

( * ) Notice: Subject to any disclaimer, the term of this patent is extended or adjusted under 35 U.S.C. 154(b) by 170 days.

(21) Appl. No.: 12/386,977

(22) Filed: Apr. 27, 2009

(65) Prior Publication Data

US 2010/0269548 A1 Oct. 28, 2010

(51) Int. Cl.
*E05B 75/00* (2006.01)

(52) U.S. Cl. ..... 24/17 AP; 24/16 PB; 128/879; 70/16

(58) Field of Classification Search ..... 24/16 PB, 24/17 AP, 30.5 P; 70/16; 206/223; 128/879; 248/74.3

See application file for complete search history.

(56) References Cited

U.S. PATENT DOCUMENTS

| | | | | | |
|---|---|---|---|---|---|
| 3,708,835 | A | * | 1/1973 | Bienz | 24/16 PB |
| 4,071,023 | A | * | 1/1978 | Gregory | 128/878 |
| 4,854,138 | A | * | 8/1989 | Charland | 70/16 |
| 4,910,831 | A | * | 3/1990 | Bingold | 24/16 PB |
| 4,964,419 | A | * | 10/1990 | Karriker | 128/879 |
| 5,088,158 | A | * | 2/1992 | Burkholder | 24/16 PB |
| D347,156 | S | * | 5/1994 | Starrett et al. | D29/120.2 |
| 5,398,383 | A | * | 3/1995 | Bingold | 24/16 PB |
| 5,443,155 | A | * | 8/1995 | Robinson | 206/223 |
| D366,129 | S | * | 1/1996 | Escoe, III | D29/120.2 |
| 5,651,376 | A | * | 7/1997 | Thompson | 128/878 |
| 5,669,110 | A | * | 9/1997 | Parsons | 24/16 PB |
| 5,704,097 | A | * | 1/1998 | Rahav | 24/16 PB |
| 5,797,404 | A | * | 8/1998 | Stanchin, II | 128/869 |
| 5,802,675 | A | * | 9/1998 | Parsons | 24/16 R |
| 5,802,888 | A | * | 9/1998 | Parsons | 70/16 |
| 6,101,682 | A | * | 8/2000 | Parsons | 24/16 PB |
| 6,219,887 | B1 | * | 4/2001 | Parsons | 24/16 PB |
| 6,364,257 | B1 | * | 4/2002 | Holder | 248/74.3 |
| 6,532,631 | B2 | * | 3/2003 | Rohaly et al. | 24/16 PB |
| 6,539,589 | B2 | * | 4/2003 | Thompson | 24/16 PB |

* cited by examiner

*Primary Examiner*—Daniel P Stodola
*Assistant Examiner*—Rowland D Do

(57) ABSTRACT

A handcuff apparatus includes a combination locking head and strap support which includes a first longitudinal axis. A first handcuff strap and a second handcuff strap are connected to the combination locking head and strap support. Each of the respective first and second handcuff straps are connected to the combination locking head and strap support. Both of the handcuff straps extend outward from the combination locking head and strap support from the same side of the strap support. Each of the respective handcuff straps includes a ratchet-bearing side and a smooth side which contacts the skin of a person to be restrained. Respective strap-supported unidirectional ratchet members are located on the respective ratchet-bearing sides. The locking head and strap support is provided with a movable locking clip or member normally supported in a first or non-engagement position within a portion of the locking head.

10 Claims, 7 Drawing Sheets

FIG 1
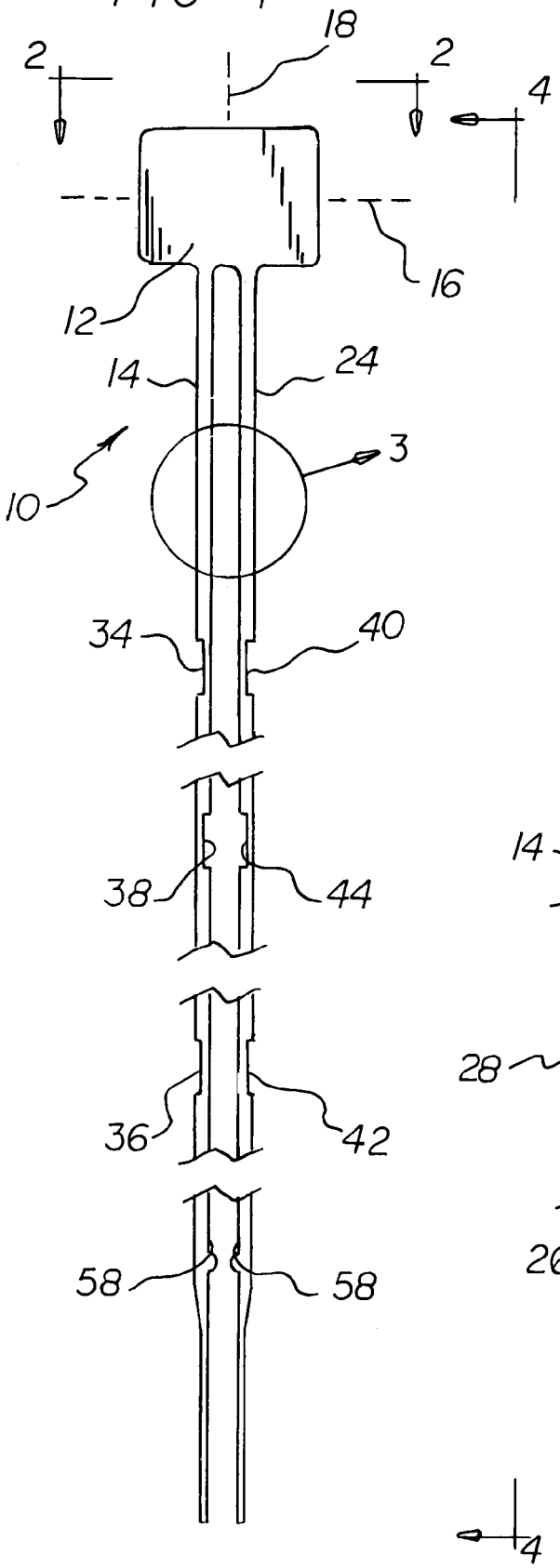
FIG 2
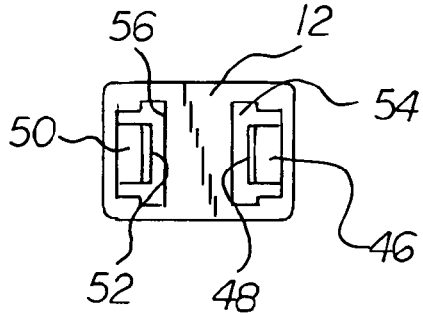
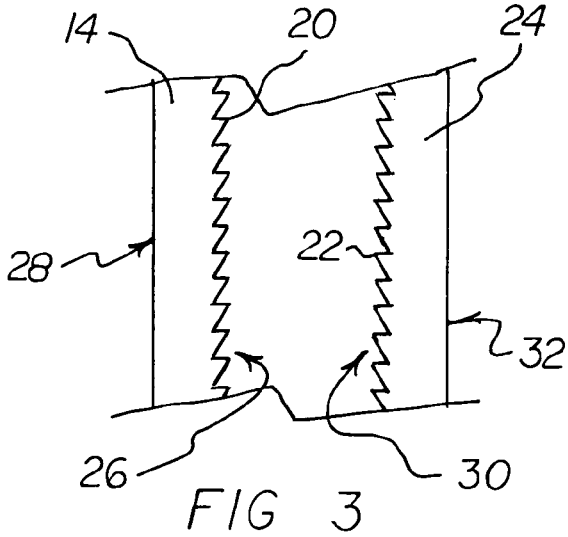
FIG 3

FIG 6
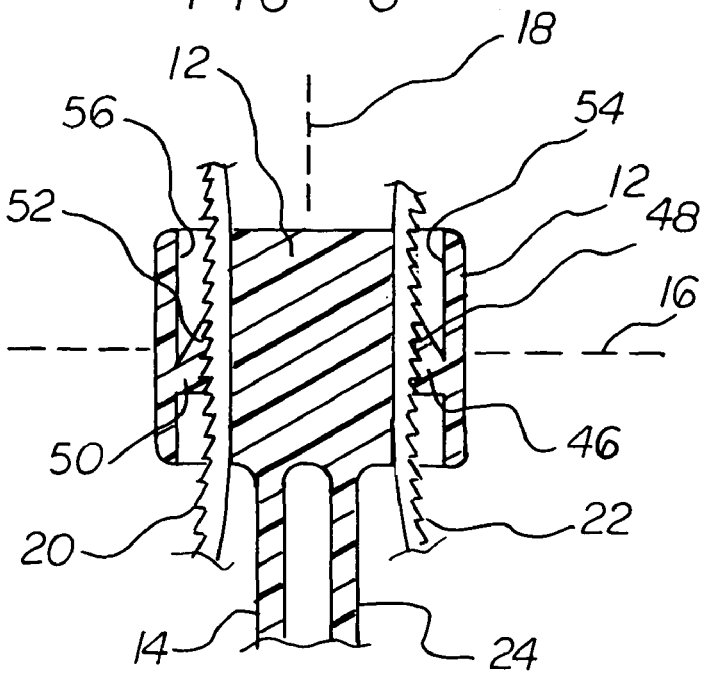
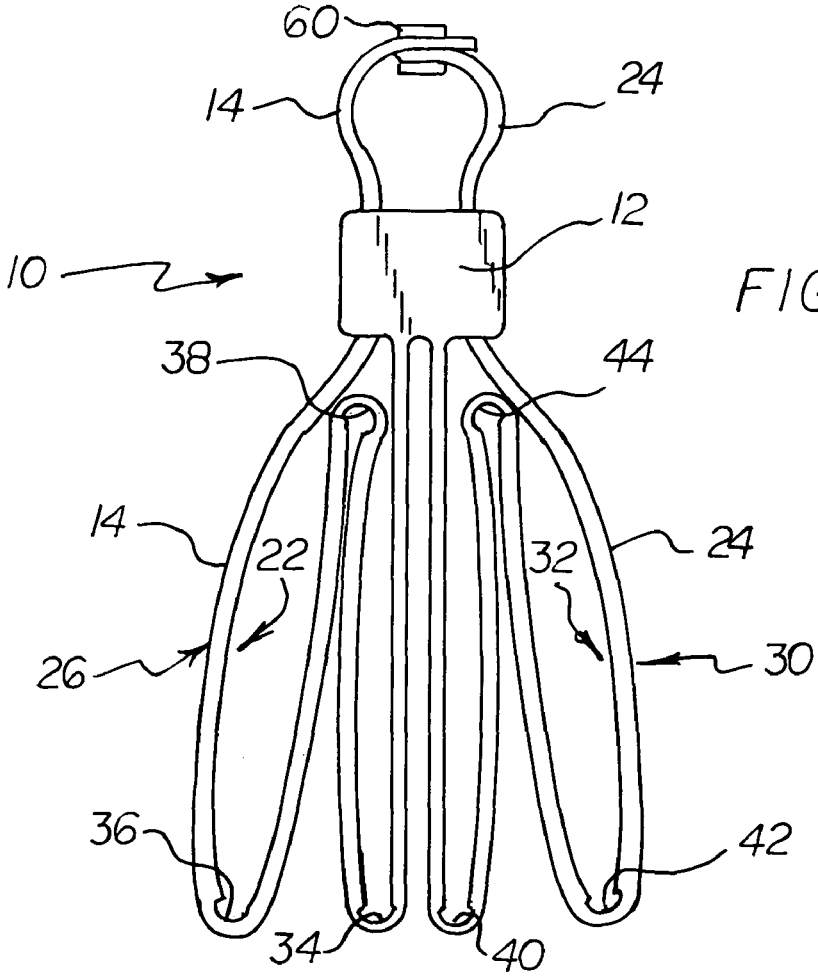
FIG 7

FIG 9
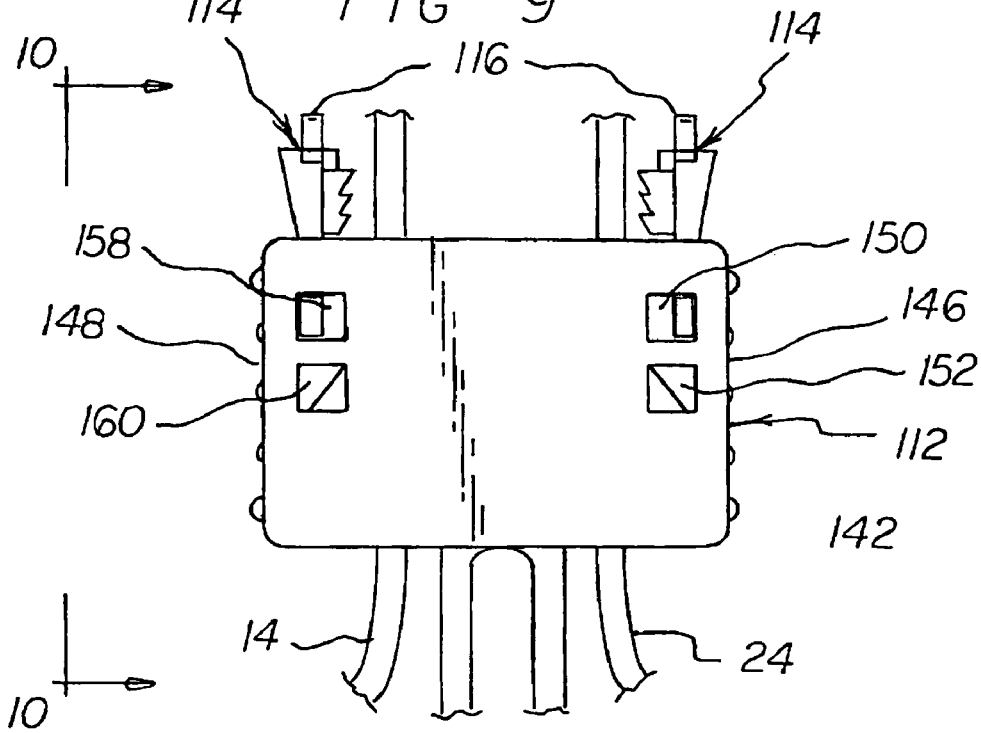
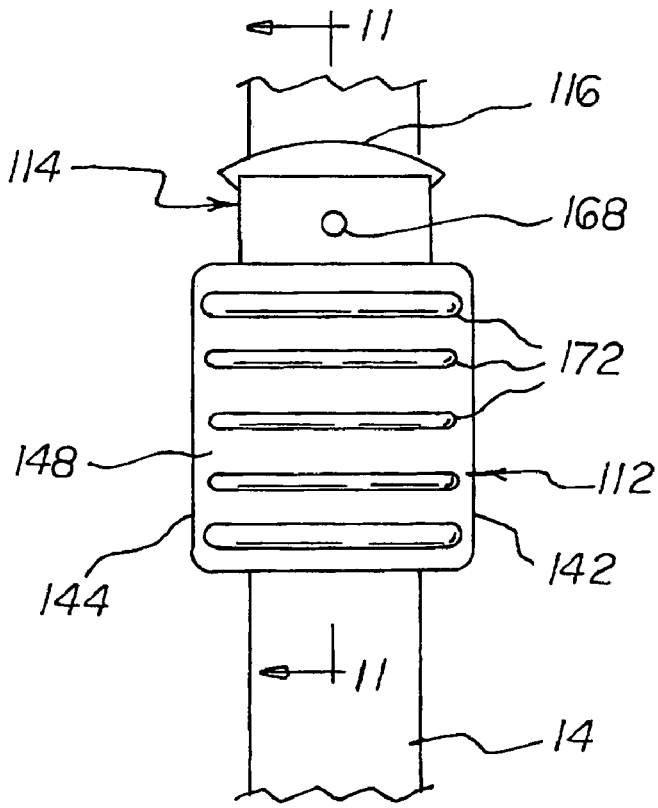
FIG 10

FIG 11
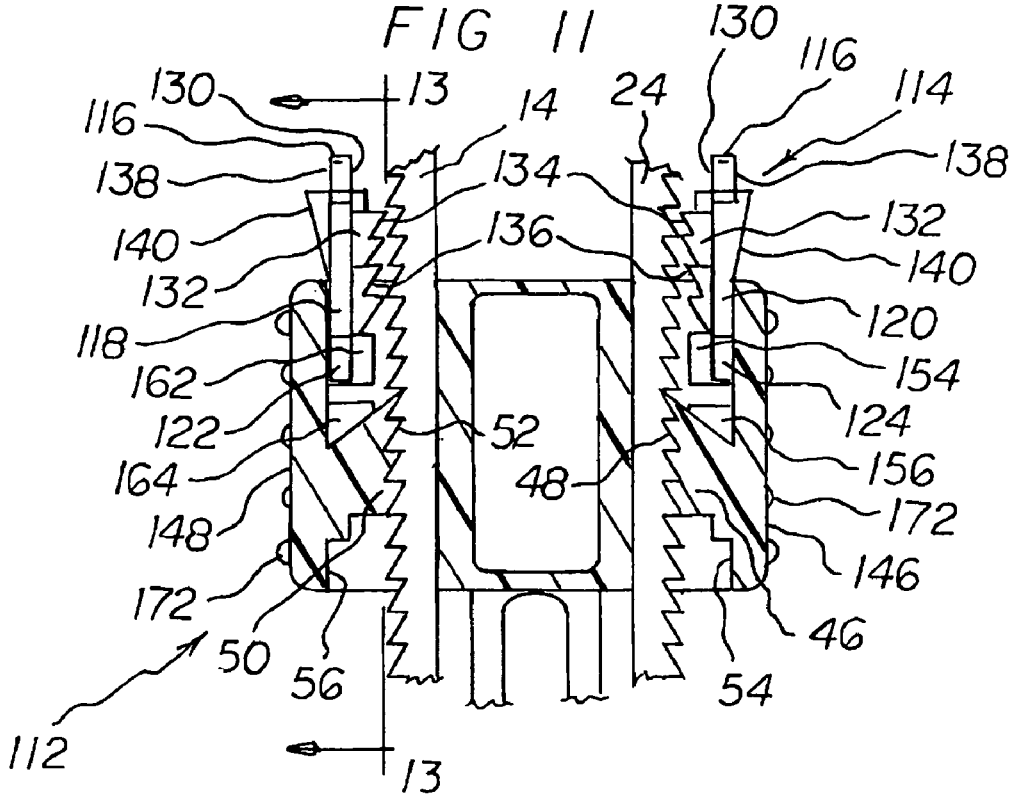
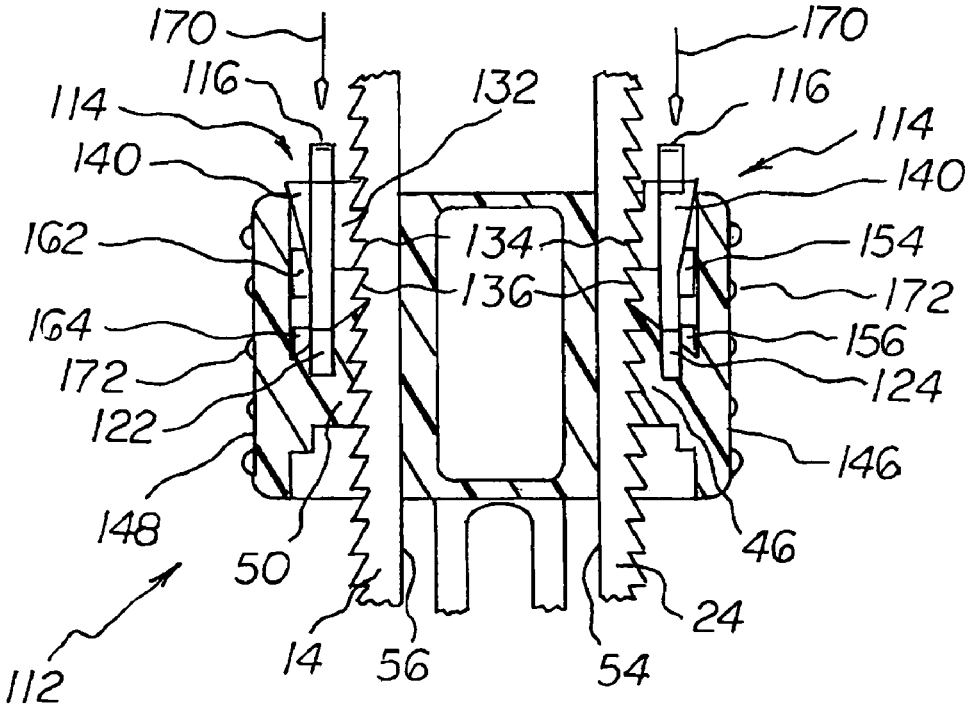
FIG 12

HANDCUFF APPARATUS

BACKGROUND OF THE INVENTION

1. Field of the Invention

The present invention relates generally to handcuff apparatuses, and, more particularly, to handcuff apparatuses that are especially adapted to be for single use and disposable.

2. Description of the Prior Art

Handcuff apparatuses are well known in the art. With one type of handcuff apparatus, a lock is provided in the apparatus, and a key is needed to unlock the lock. Such handcuff apparatuses can be used over and over again. With another type of handcuff apparatus, the apparatus is designed without having a key-operated lock. Such apparatuses are often for single use and are disposable.

Throughout the years, a number of innovations have been developed relating to handcuff apparatuses that do not have key-controlled locks, and the following U.S. patents are representative of some of those innovations: U.S. Pat. Nos. 4,854,138, 5,088,158, 5,398,383, 5,443,155, 5,802,675, and Des. 347,156.

More specifically, U.S. Pat. No. 4,854,138 discloses a handcuff assembly where a soft, braided material is formed in a pair of loops, serving as handcuffing straps, and threaded through a separate and distinct locking head. After being pulled tight through the head, the handcuffing straps are knotted on the backside of the head. The handcuffing straps and the locking head are made of dissimilar material. With a locking head that is a separate and distinct unit from the handcuffing straps, the two units can be unintentionally separated from each other, rendering both separated units useless. In this respect, rather than having handcuffing straps that are separate and distinct units from a locking head, it would be desirable if a handcuff apparatus were provided in which the handcuffing straps and the locking head were made as a unified, integrated structure. Also, rather than having one material comprising handcuffing straps and another material comprising a locking head, it would be desirable if a handcuff apparatus were provided in which both the handcuffing straps and the locking head were made from the same material.

U.S. Pat. No. 5,088,158 discloses a handcuff assembly for use by a person applying the handcuff assembly to a person to be restrained. The handcuff assembly is of one-piece design where two handcuffing straps are passed through two juxtaposed locking channels provided in a single locking head. The ends of the two straps connected to the locking head project from the locking head parallel to the vertical axis of the locking head. The free ends of the two straps pass through the locking head in opposite directions perpendicular to the vertical longitudinal axis of the locking head. Since the two straps are passed through the locking head in opposite directions, the two free ends of the two straps cannot be grasped by one hand of the person applying the handcuffs to the person to be restrained. Rather than requiring both hands of the person applying the handcuffs to be used in the application process, it would be desirable if a handcuff apparatus were provided in which only one hand of the person applying the handcuff apparatus need be used. It is also noted that there are locking teeth or serrations on each strap face toward the wrists of the person being restrained. To avoid unnecessary injury or discomfort to a restrained person's skin, it would be desirable if a handcuff apparatus were provided in which locking teeth of handcuff straps do not contact the restrained person's skin.

U.S. Pat. No. 5,398,383 discloses a one-piece handcuff assembly with two locking channels and two additional channels to enable compact storage of the handcuff straps before deployment. it is noted that the handcuff straps are attached to the locking head on opposite ends of the locking head. As shown in FIG. 2 of U.S. Pat. No. 5,398,383, before deployment on a person to be restrained, both handcuff straps and the locking head are coaxial along a longitudinal axis of the locking head. In the storage mode shown in FIG. 1 of U.S. Pat. No. 5,398,383, each free end of each handcuff strap must be pulled backward and out from the locking head before the respective handcuff strap can be deployed on a person to be restrained. Such manipulation of the handcuff straps take time and effort. Moreover, the person applying the handcuffs must use both hands to carry out such manipulations. To prevent the need for such manipulations of handcuff straps, it would be desirable if a handcuff apparatus were provided in which handcuff straps in a storage mode are ready to be deployed with a one-hand operation without removing free ends of the handcuff straps from the locking head. Moreover, since the free ends of the handcuff straps are not connected together, once the handcuff straps are deployed on the person to be restrained, the two straps cannot be tightened together with a one-hand operation.

U.S. Pat. No. 5,443,155 discloses a handcuff assembly having loop strands. Each loop strand has an end piece 22 having a channel therein, and each loop strand has a free end which is looped around to pass through the channel in the free end. The end pieces 22 are separated from each other by a spacer piece 32 and a cinch bar 34. As shown in FIG. 1 of U.S. Pat. No. 5,443,155, this handcuff apparatus has at least four separate and distinct component parts. As stated above, it would be desirable if a handcuff apparatus had a unified, integrated structure. Moreover, for purposes of simplicity of manufacture, it would be desirable if a handcuff apparatus did not include handcuff straps that have end pieces with channels therethrough.

U.S. Pat. No. 5,802,675 discloses a handcuff assembly with a multiple-piece head that is locked together by the loop straps and also features folded loops. More specifically, each handcuff strap has its own separate and distinct combined strap support and locking head. An interlocking cover 20 is used to link together each separate and distinct combined strap support and locking head. Only when a free end of a handcuff strap passes through both its respective locking head and the interlocking cover 20, will the respective locking head be connected with the interlocking cover 20. Without both respective handcuff straps being passed through both their respective locking heads and the interlocking cover 20, will both respective locking heads be connected together by means of the interlocking cover 20. To avoid such complexities, it would be desirable if a handcuff apparatus were provided which does not require an interlocking cover to connect together two separate and distinct combined strap support and locking head units.

Also, in U.S. Pat. No. 5,802,675, notches 54 are provided in the straps to facilitate folding the straps in a serpentine fashion in a storage mode. However, in none of the figures in U.S. Pat. No. 5,802,675 is there any disclosure of deploying both handcuff straps by a user employing only one hand.

U.S. Pat. No. Des. 347,156 discloses handcuffs made by Monadnock Lifetime Products. In the nondeployed state, the two straps and the locking head are arranged along a common longitudinal axis, as shown in FIGS. 3 and 5. There is no disclosure of a storage mode in which handcuff straps are stored in a compact serpentine manner.

Still other features would be desirable in a handcuff apparatus. For example, it would be desirable that the apparatus would be difficult to pick and unlock. Also, it would desirable for a handcuff apparatus to be easily folded up for a storage mode.

Also, it would be desirable for a handcuff apparatus to be made from a material which provides maximum tensile strength having minimal flex modulus so that the handcuff straps can still be easily folded.

Also, it would be desirable for a handcuff apparatus to include a large flat writing surface which allows for coding and identification of the restrained person.

Also, it would be desirable for a handcuff apparatus to be provided in different color versions that can be coded with respect to the degree of danger or other factors to be taken into consideration with respect to the restrained person.

Further yet, it would be desirable for at least one preferred embodiment of the handcuff apparatus disclosed and claimed herein to include a locking head assembly having a movable locking member or clip movable between a first non-locking condition and a second locking condition to enhance the ability of the handcuff apparatus and of the locking head assembly thereof to resist picking.

Thus, while the foregoing body of prior art indicates it to be well known to use handcuff apparatuses, the prior art described above does not teach or suggest a handcuff apparatus which has the following combination of desirable features: (1) provides an apparatus in which the handcuffing straps and the locking head are made as a unified, integrated structure; (2) provides a handcuff apparatus in which both the handcuffing straps and the locking head are made from the same material; (3) provides a handcuff apparatus with which only one hand of the person applying the handcuff apparatus need be used; (4) has locking teeth on the handcuff straps which do not contact the restrained person's skin; (5) in which handcuff straps in a storage mode are ready to be deployed with a one-hand operation without removing free ends of the handcuff straps from the locking head; (6) does not include handcuff straps that have end pieces with channels therethrough; (7) does not require an interlocking cover to connect together two separate and distinct combined strap support and locking head units; (8) is difficult to pick and unlock; (9) can be easily folded up for a storage mode; (10) is made from a material which provides maximum tensile strength having minimal flex modulus so that the handcuff straps can be easily folded; (11) has a large flat writing surface which allows for coding and identification of the restrained person; (12) can be made in different color versions that can be color-coded with respect to the degree of danger or other factors to be taken into consideration with respect to the restrained person; and (13) features a locking head assembly with a locking clip or member movable between a first non-locking condition and a second secure locking condition. The foregoing desired characteristics are provided by the unique handcuff apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a handcuff apparatus which includes a combination locking head and strap support which includes a first longitudinal axis. A first handcuff strap and a second handcuff strap are connected to the combination locking head and strap support. The first handcuff strap and the second handcuff strap are connected to the combination locking head and strap support parallel to a second longitudinal axis which is substantially perpendicular to the first longitudinal axis. In this respect, both the first handcuff strap and the second handcuff strap extend outward from the combination locking head and strap support from the same side of the combination locking head and strap support.

The first handcuff strap includes a first ratchet-bearing side and a first smooth side, and first strap-supported unidirectional ratchet members are located on the first ratchet-bearing side. The second handcuff strap includes a second ratchet-bearing side and a second smooth side, and second strap-supported unidirectional ratchet members are located on the second ratchet-bearing side. Either the first ratchet-bearing side or the second ratchet-bearing side includes a smooth identification reception region.

The first handcuff strap includes a first proximal recessed folding crease and a first distal recessed folding crease located on the first smooth side and includes a first intermediate recessed folding crease located on the first ratchet-bearing side. Similarly, the second handcuff strap includes a second proximal recessed folding crease and a second distal recessed folding crease located on the second smooth side and includes a second recessed intermediate folding crease located on the second ratchet-bearing side.

The combination locking head and strap support includes a first strap-reception channel which receives a free end portion of the first handcuff strap. A first locking ratchet support member extends into the first strap-reception channel, and first unidirectional locking ratchets are supported by the first locking ratchet support member. The first unidirectional locking ratchets engage the first strap-supported unidirectional ratchet members.

Also the combination locking head and strap support includes a second strap-reception channel which receives a free end portion of the second handcuff strap. A second locking ratchet support member extends into the second strap-reception channel, and second unidirectional locking ratchets are supported by the second locking ratchet support member. The second unidirectional locking ratchets engage the second strap-supported unidirectional ratchet members.

The first locking ratchet support member is flexible such that if an unlocking force is exerted on the first handcuff strap, the first locking ratchet support member presses the first unidirectional locking ratchets harder against an opposite wall of the first strap-reception channel, thereby increasing the locking power of the first unidirectional locking ratchets against the first strap-supported unidirectional ratchet members on the first handcuff strap.

Similarly, the second locking ratchet support member is flexible such that if an unlocking force is exerted on the second handcuff strap, the second locking ratchet support member presses the second unidirectional locking ratchets harder against an opposite wall of the second strap-reception channel, thereby increasing the locking power of the second unidirectional locking ratchets against the second strap-supported unidirectional ratchet members on the second handcuff strap. The first unidirectional locking ratchets includes four first unidirectional locking ratchets, and the second unidirectional locking ratchets includes four second unidirectional locking ratchets. Preferably, both of the first locking ratchet support member and the second locking ratchet support member are flexible support members.

In an alternatively preferred embodiment of the invention, the locking head and strap support is modified to provide for a movable locking clip or member adapted to enhance further the pick-resistance of the hand cuff apparatus of the invention. The locking clip or member normally is supported in a first or non-engagement position within the top portion of the locking head. When the handcuff apparatus is applied to a person being restrained, the clip is depressed into the head until it suitably locks in place in a second "locked" condition characterized by additional ratchet teeth provided on the locking clip meshing with corresponding complimentary ratchet teeth on the juxtaposed strap being supported therein. By this unique arrangement, an extremely secure, pick-resistant, enhanced locking effect is achieved.

If desired, the combination locking head and strap support, the first handcuff strap, and the second handcuff strap can be color-coded.

If desired, free ends of the first handcuff strap and the second handcuff strap can be connected together by a rivet assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved handcuff apparatus which has all of the advantages of the prior art and none of the disadvantages.

It is another object of the present invention to provide a new and improved handcuff apparatus which may be easily and efficiently manufactured and marketed.

It is a further object of the present invention to provide a new and improved handcuff apparatus which is of durable and reliable construction.

An even further object of the present invention is to provide a new and improved handcuff apparatus which is susceptible of a low cost of manufacture with regard to both materials and labor, and which accordingly is then susceptible of low prices of sale to the consuming public, thereby making such handcuff apparatus available to the buying public.

Still yet a further object of the present invention is to provide a new and improved handcuff apparatus in which the handcuffing straps and the locking head are made as a unified, integrated structure.

Still another object of the present invention is to provide a new and improved handcuff apparatus in which both the handcuffing straps and the locking head are made from the same material.

Yet another object of the present invention is to provide a new and improved handcuff apparatus with which only one hand of the person applying the handcuff apparatus need be used.

Even another object of the present invention is to provide a new and improved handcuff apparatus that has locking teeth on the handcuff straps which do not contact the restrained person's skin.

Still a further object of the present invention is to provide a new and improved handcuff apparatus which in which handcuff straps in a storage mode are ready to be deployed with a one-hand operation without removing free ends of the handcuff straps from the locking head.

Yet another object of the present invention is to provide a new and improved handcuff apparatus that does not include handcuff straps that have end pieces that have strap-reception channels therethrough.

Still another object of the present invention is to provide a new and improved handcuff apparatus which does not require an interlocking cover to connect together two separate and distinct combined strap support and locking head units.

Yet another object of the present invention is to provide a new and improved handcuff apparatus that is difficult to pick and unlock.

Still a further object of the present invention is to provide a new and improved handcuff apparatus that can be easily folded up for a storage mode and easily unfolded when removed from storage.

Yet another object of the present invention is to provide a new and improved handcuff apparatus which is made from a material which provides maximum tensile strength having minimal flex modulus so that the handcuff straps can be easily folded.

Still a further object of the present invention is to provide a new and improved handcuff apparatus that has a large flat writing surface which allows for coding and identification of the restrained person.

Yet another object of the present invention is to provide a new and improved handcuff apparatus which can be made in different color versions that can be color-coded with respect to the degree of danger or other factors to be taken into consideration with respect to the restrained person.

Yet still another object of the present invention is to provide a new and improved handcuff apparatus including a locking head assembly having a movable locking member or clip movable between a first non-locking condition and a second locking condition to enhance the ability of the handcuff apparatus and of the locking head assembly thereof to resist picking.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a first side view showing a preferred embodiment of the handcuff apparatus of the invention, wherein the apparatus is in an open and extended condition without handcuff loops formed.

FIG. 2 is a top view of the embodiment of the handcuff apparatus shown in FIG. 1 taken along line 2-2 of FIG. 1.

FIG. 3 is an enlarged side view of the embodiment of the portion of the handcuff apparatus of FIG. 1 that is contained in circled region 3 thereof.

FIG. 6 is a partial cross-sectional view of the portion of the embodiment of the invention shown in FIG. 5, taken along line 6-6 thereof.

FIG. 7 is a first side view of the embodiment of the invention shown in FIG. 5, wherein the apparatus is folded around respective folding creases to form a storage mode for the handcuff apparatus.

FIG. 9 is a front view in elevation of the combined locking head and strap support portion of an alternatively preferred embodiment of the invention.

FIG. 10 is a side view in elevation of the combined locking head and strap support portion of the alternatively preferred embodiment of the invention depicted in FIG. 9.

FIG. 11 is a cross-sectional view taken along line 11-11 in FIG. 10 showing a movable locking clip or member in a first position within the locking head.

FIG. 12 is a cross-sectional view taken along line 11-11 in FIG. 10 showing the movable locking clip or member in a second moved position within the locking head.

DESCRIPTION OF THE PREFERRED EMBODIMENT

Figure 4:
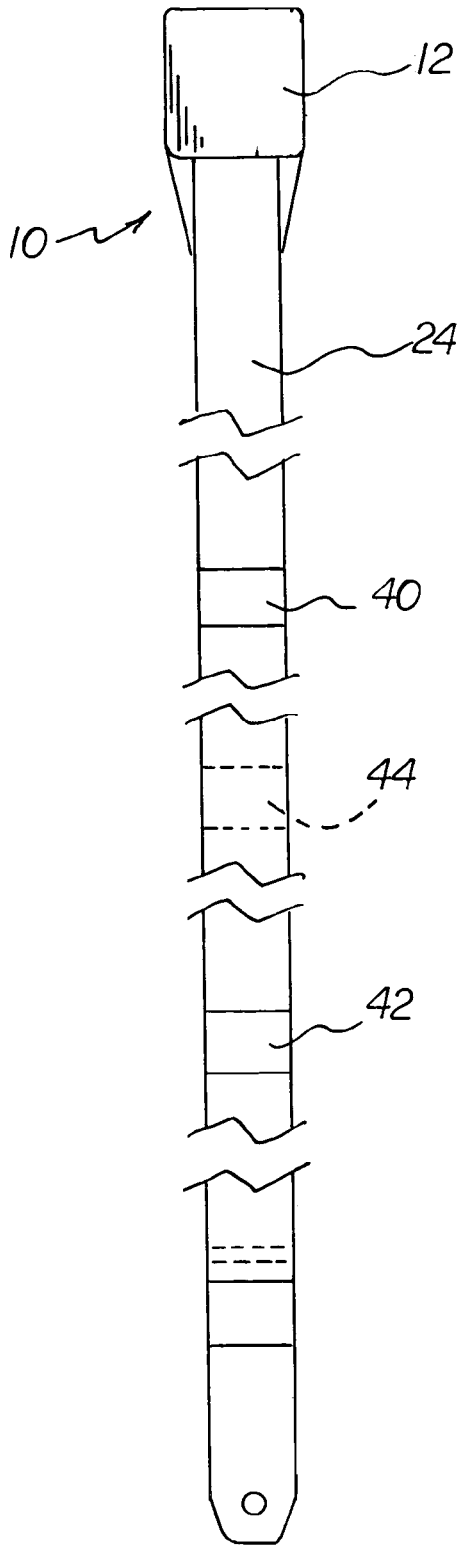
FIG. 4 is a second side view of the embodiment of the invention shown in FIG. 1, taken along line 4-4 thereof.

With reference to the drawings, a new and improved handcuff apparatus embodying the principles and concepts of the present invention will be described.

Turning to FIGS. 1-8, there is shown a preferred embodiment of the handcuff apparatus of the invention generally designated by reference numeral 10. In each of the figures, reference numerals are shown that correspond to like reference numerals that designate like elements shown in other figures.

A handcuff apparatus 10 includes a combination locking head and strap support 12 which includes a first longitudinal axis 16. A first handcuff strap 14 and a second handcuff strap 24 are connected to the combination locking head and strap support 12. The first handcuff strap 14 and the second handcuff strap 24 are connected to the combination locking head and strap support 12 parallel to a second longitudinal axis 18 which is substantially perpendicular to the first longitudinal axis 16, wherein both the first handcuff strap 14 and the second handcuff strap 24 extend outward from the combination locking head and strap support 12 from the same side of the combination locking head and strap support 12.

The first handcuff strap 14 includes a first ratchet-bearing side 26 and a first smooth side 28, wherein first strap-supported unidirectional ratchet members 20 are located on the first ratchet-bearing side 26. The second handcuff strap 24 includes a second ratchet-bearing side 30 and a second smooth side 32, wherein second strap-supported unidirectional ratchet members 22 are located on the second ratchet-bearing side 30.

Either the first ratchet-bearing side 26 or the second ratchet-bearing side 30 includes a smooth identification reception region 58. The smooth identification reception region 58 permits an adhesive identification label to be applied to a selected handcuff strap.

The first handcuff strap 14 includes a first proximal folding crease 34 and a first distal folding crease 36 located on the first smooth side 28 and includes a first intermediate folding crease 38 located on the first ratchet-bearing side 26. The second handcuff strap 24 includes a second proximal folding crease 40 and a second distal folding crease 42 located on the second smooth side 32 and includes a second intermediate folding crease 44 located on the second ratchet-bearing side 30.

The combination locking head and strap support 12 includes a first strap-reception channel 56 which receives a free end portion of the first handcuff strap 14. A first locking ratchet support member 50 extends into the first strap-reception channel 56, and first unidirectional locking ratchets 52 are supported by the first locking ratchet support member 50. The first unidirectional locking ratchets 52 engage the first strap-supported unidirectional ratchet members 20.

A second strap-reception channel 54 receives a free end portion of the second handcuff strap 24. A second locking ratchet support member 46 extends into the second strap-reception channel 54, and second unidirectional locking ratchets 48 are supported by the second locking ratchet support member 46. The second unidirectional locking ratchets 48 engage the second strap-supported unidirectional ratchet members 22.

The first locking ratchet support member 50 is flexible such that if an unlocking force is exerted on the first handcuff strap 14, the first locking ratchet support member 50 presses the first unidirectional locking ratchets 52 harder against an opposite wall of the first strap-reception channel 56, thereby increasing the locking power of the first unidirectional locking ratchets 52 against the first strap-supported unidirectional ratchet members 20 on the first handcuff strap 14.

The second locking ratchet support member 46 is flexible such that if an unlocking force is exerted on the second handcuff strap 24, the second locking ratchet support member 46 presses the second unidirectional locking ratchets 48 harder against an opposite wall of the second strap-reception channel 54, thereby increasing the locking power of the second unidirectional locking ratchets 48 against the second strap-supported unidirectional ratchet members 22 on the second handcuff strap 24.

Preferably, the first unidirectional locking ratchets 52 include four first unidirectional locking ratchets 52, and the second unidirectional locking ratchets 48 include four second unidirectional locking ratchets 48. Preferably, both the first locking ratchet support member 50 and the second locking ratchet support member 46 are flexible support members.

Although dimensions can vary as desired, with one suitable embodiment of the invention, the distance between the combination locking head and strap support 12 and the first proximal folding crease 34 or the second proximal folding crease 40 can be 5.0851 inches. The distance between the combination locking head and strap support 12 and the first intermediate folding crease 38 or the second intermediate folding crease 44 can be 10.0701 inches. The distance between the combination locking head and strap support 12 and the first distal folding crease 36 or the second distal folding crease 42 can be 15.0551 inches. The distance between the combination locking head and strap support 12 and the smooth identification reception region 58 can be 20.7700 inches. The distance between the smooth identification reception region 58 and the end of the first handcuff strap 14 or the second handcuff strap 24 can be 2.3750 inches. The ends of the first handcuff strap 14 or the second handcuff strap 24 can be 0.0400 inch thick. With respect to the first handcuff strap 14 and the second handcuff strap 24, the spacing between the first handcuff strap 14 and the second handcuff strap 24 on the combination locking head and strap support 12 can be 0.3870 inch. The height of the combination locking head and strap support 12 can be 1.3470 inches. The length of the combination locking head and strap support 12 can be 1.0000 inch.

If desired, the combination locking head and strap support 12, the first handcuff strap 14, and the second handcuff strap 24 are color-coded. Also, the free ends of the first handcuff strap 14 and the second handcuff strap 24 can be connected together by a rivet assembly 60.

The preferred embodiment of the invention of the handcuff apparatus 10 is manufactured as a unified, integrated structure as shown in FIGS. 1-4. It is clear that the first longitudinal axis 16 extending through the combination locking head and strap support 12 and the second longitudinal axis 18, that is parallel to the first handcuff strap 14 and the second handcuff strap 24, are perpendicular to each other.

Once the handcuff apparatus 10 is manufactured, the apparatus is configured into the storage mode as shown in FIG. 7. To do so, the free end of the first handcuff strap 14 is passed through the first strap-reception channel 56 so that the first strap-supported unidirectional ratchet members 20 engage the first unidirectional locking ratchets 52. Similarly, the free end of the second handcuff strap 24 is passed through the second strap-reception channel 54 so that the second strap-supported unidirectional ratchet members 22 engage the second unidirectional locking ratchets 48. Then, the first handcuff strap 14 is folded around first proximal folding crease 34, around the first intermediate folding crease 38, and around the first distal folding crease 36 as shown in FIG. 7. In addition, the second handcuff strap 24 is folded around the second proximal folding crease 40, around the second intermediate folding crease 44, and around the second distal folding crease 42 as shown in FIG. 7. In the storage configuration, the handcuff apparatus 10 is compact and takes up relatively little storage space.

It is preferred that a formulation of thermoplastic resin be used to mold the handcuff apparatus as is well known in the art such that maximum tensile strength with minimal flex modulus is achieved in order that the straps can still be folded. Thermoplastic compounds that are too stiff to be folded in the thickness used for the handcuff apparatus 10 of the invention should be avoided.

Figure 5:
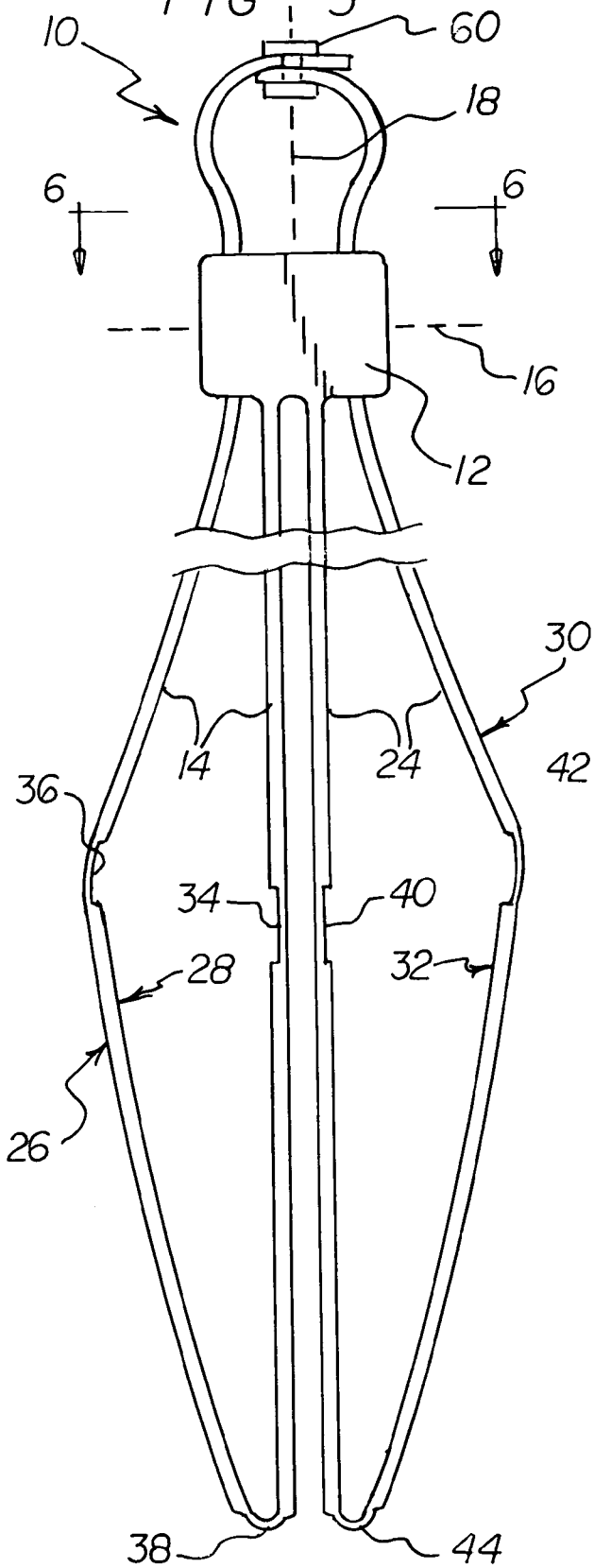
FIG. 5 is a front side view the embodiment of the invention shown in FIG. 1, wherein the handcuff straps have been folded around folding creases, and wherein ends of the handcuff straps have been passed through the strap-reception channels in the combination locking head and strap support to form handcuff loops for deployment on a person needing handcuff restraint.

To deploy the handcuff apparatus 10 for application to the wrists of a person to be restrained, a user first pulls outward on the first intermediate folding crease 38 and the second intermediate folding crease 44 so that handcuff loops are formed as shown in FIG. 5. Then, the user places the wrists of the person to be restrained through the handcuff loops. When the wrists are encircled by the looped first handcuff strap 14 and the looped second handcuff strap 24, the user pulls upward on the ends of the first handcuff strap 14 and the second handcuff strap 24 which are fastened together by rivet assembly 60, as shown by directional arrow 62. As this is done, some of the first strap-supported unidirectional ratchet members 20 pass by the first unidirectional locking ratchets 52 in the combination locking head and strap support 12, and some of the second strap-supported unidirectional ratchet members 22 pass by the second unidirectional locking ratchets 48 in the combination locking head and strap support 12.

Figure 8:
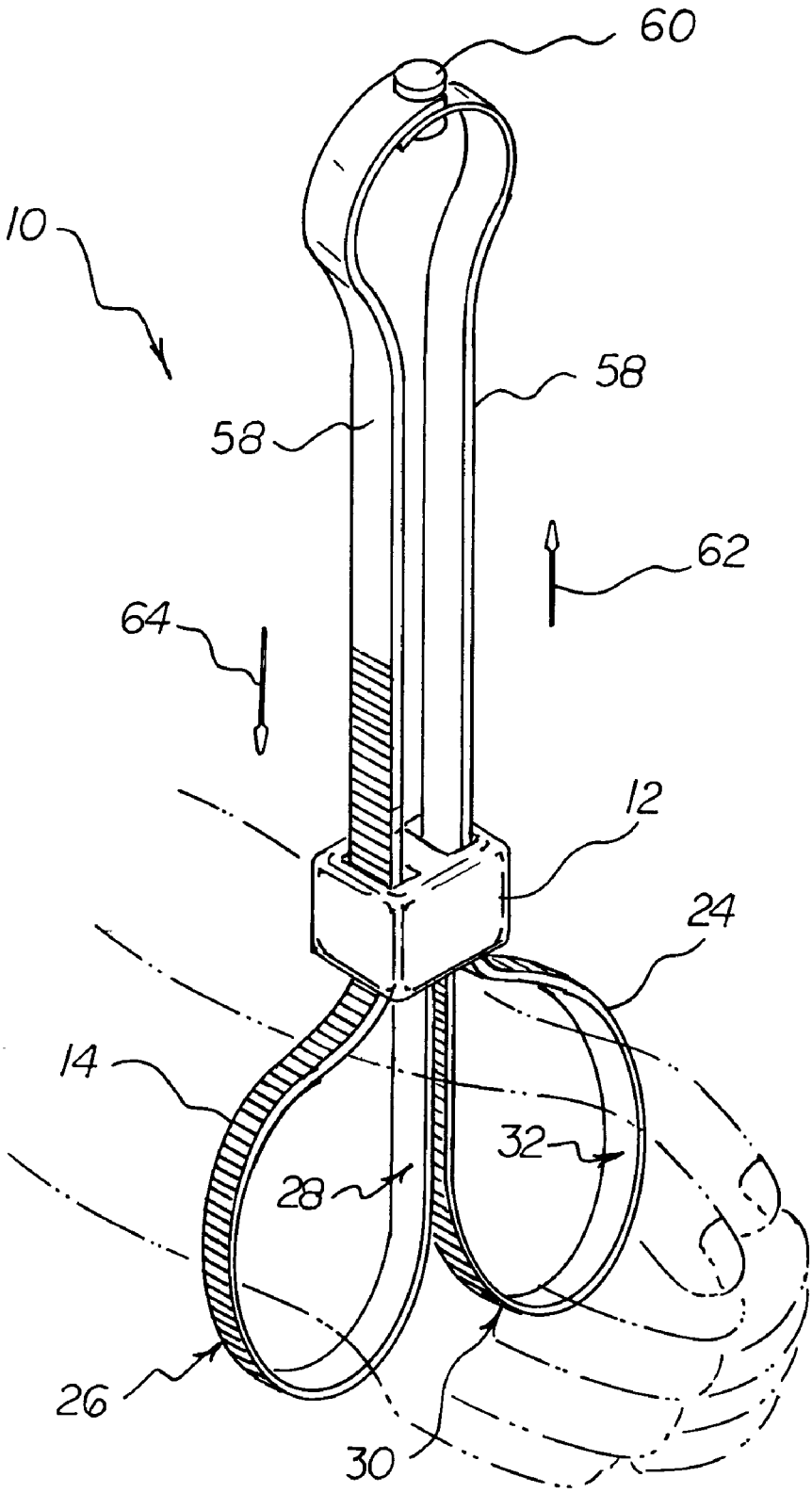
FIG. 8 is a perspective view of the preferred embodiment of the invention is place, restraint the wrists of a person needing handcuff restraint.

Finally, to fully secure the wrists of the person to be restrained by the handcuff apparatus 10, as shown in FIG. 8, the ends of the first handcuff strap 14 and the second handcuff strap 24 are pulled in the direction shown by directional arrow 62 sufficiently away from the combination locking head and strap support 12 so that the first handcuff strap 14 and the second handcuff strap 24 are tight around the respective wrists encircled therein.

If a restrained person, as shown in FIG. 8, attempts to escape from the handcuff apparatus 10 by pulling the first handcuff strap 14 in the direction shown by directional arrow 64, which is the direction opposite to directional arrow 62 of installation, the engagement of the first unidirectional locking ratchets 52 with the first strap-supported unidirectional ratchet members 20 prevents the first handcuff strap 14 from being moved along this direction. Therefore, the first handcuff strap 14 remains tight on one of the wrists.

Similarly, if the restrained person attempts to escape from the handcuff apparatus 10 by pulling the second handcuff strap 24 in the direction shown by directional arrow 64, which is the direction opposite to directional arrow 62 of installation, the engagement of the second unidirectional locking ratchets 48 with the second strap-supported unidirectional ratchet members 22 prevents the second handcuff strap 24 from being moved along this direction. Therefore, the first handcuff strap 14 remains tight on the one of the wrists.

It is noted that both the first locking ratchet support member 50 and the second locking ratchet support member 46 are flexible. As a result, when either respective first handcuff strap 14 or second handcuff strap 24 is pulled in the direction of the directional arrow 64, the respective first locking ratchet support member 50 and second locking ratchet support member 46 cause the respective first unidirectional locking ratchets 52 and second unidirectional locking ratchets 48 to press harder against the respective first strap-supported unidirectional ratchet members 20 and second strap-supported unidirectional ratchet members 22 and against the respective opposite walls of the respective first strap-reception channel 56 and second strap-reception channel 54, thereby applying more preventive force on the respective first strap-supported unidirectional ratchet members 20 and second strap-supported unidirectional ratchet members 22 to prevent movement of the respective first handcuff strap 14 and second handcuff strap 24 in the direction of directional arrow 64.

Also, when plural, such as four, first unidirectional locking ratchets 52 and second unidirectional locking ratchets 48 are present, there is great security against a prying tool causing release of the grip of the respective first unidirectional locking ratchets 52 and second unidirectional locking ratchets 48 on the respective first strap-supported unidirectional ratchet members 20 and second strap-supported unidirectional ratchet members 22 if the prying tool is used to try to separate the first unidirectional locking ratchets 52 from the first strap-supported unidirectional ratchet members 20 and to separate the second unidirectional locking ratchets 48 from the second strap-supported unidirectional ratchet members 22.

Stated somewhat differently, there can be four first unidirectional locking ratchets 52 and four second unidirectional locking ratchets 48. These respective four ratchets help prevent the picking from a prisoner and provide maximum surface area for a strong lock. As tension is put on the combination locking head and strap support 12, there is a radius on the bottom corner to allow flex without breaking. This flex forces the respective handcuff strap against the opposite wall of the respective strap-reception channel to provide a tighter locking grip.

In this respect, it is noted that if a prisoner is able to pick a first unidirectional locking ratchet on a respective locking ratchet support member, by inserting a small sharp object into a respective strap-reception channel, the prisoner will be unable to reach the remaining three unidirectional locking ratchets, thus making the handcuff apparatus 10 virtually impossible to get off by defeating the locking features.

Figure 13:
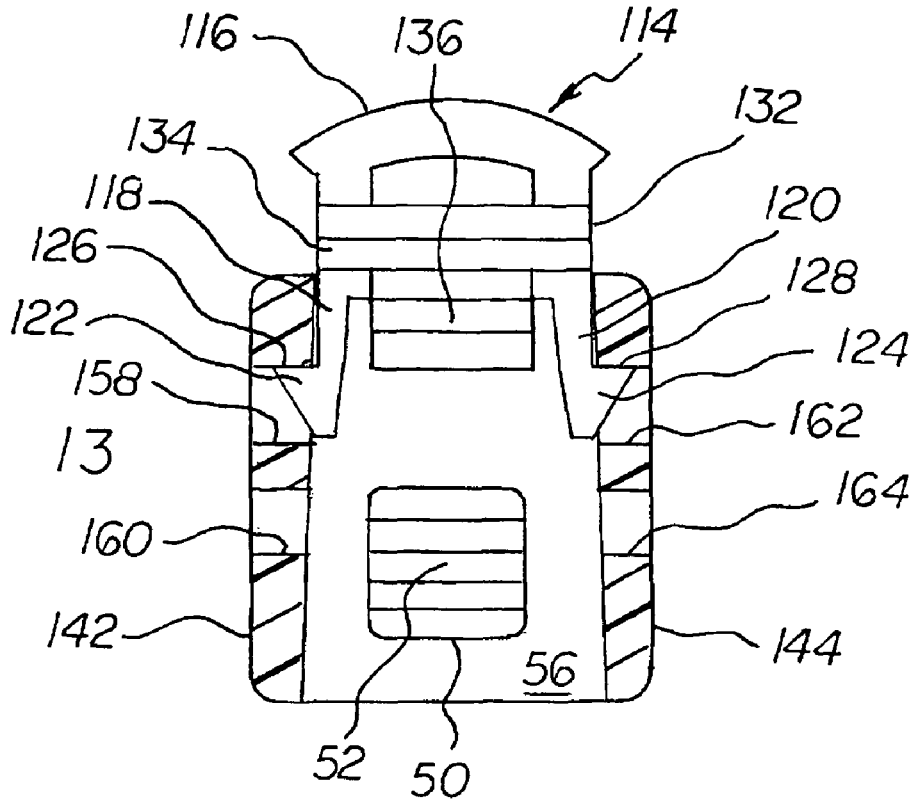
FIG. 13 is a cross-sectional view taken along line 13-13 in FIG. 11 showing the locking clip member in a first position within the locking head.
Figure 14:
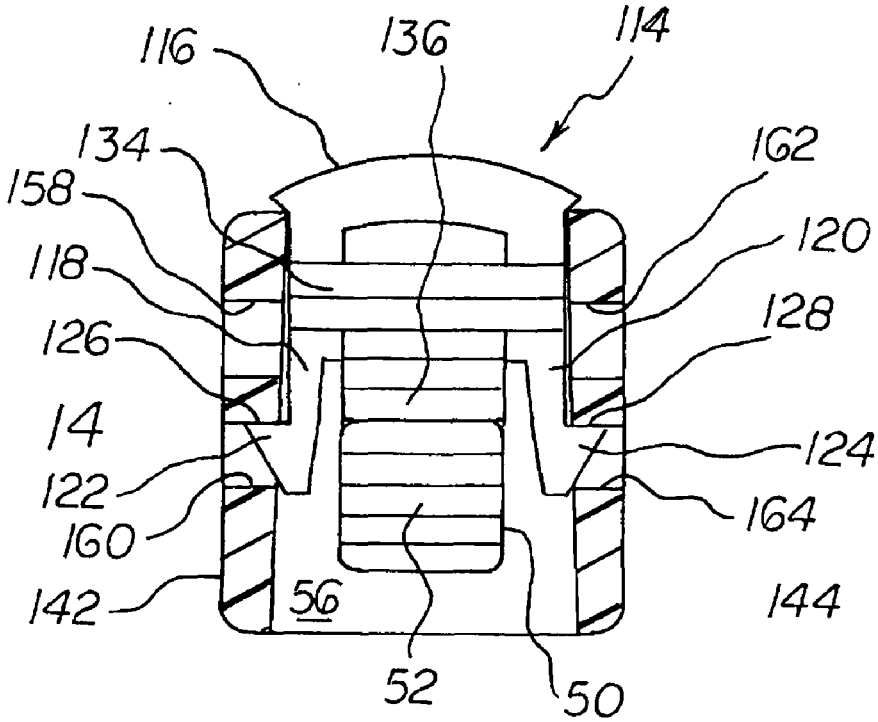
FIG. 14 is a cross-sectional view taken along line 13-13 in FIG. 11 showing the locking clip member in a second moved position within the locking head.

An alternatively preferred way to render the handcuff apparatus of the present invention even more pick-proof is to employ a slidingly movable locking clip or member in conjunction with the locking head and strap support. Such an alternatively preferred embodiment is shown in FIGS. 9-14 where the locking head and strap support 112 is somewhat enlarged transversely to accommodate a movable (slidable) locking clip or member 114. In the ensuing description of this alternatively preferred embodiment, like reference numerals are employed to refer to like parts already described above. Clip 114 generally is U-shaped and includes a central depressor portion 116 and a pair of opposed retainer prongs 118, 120 each of which terminates distally in a corresponding outwardly extending barb 122, 124, substantially as depicted. Each barb 122, 124, in turn, defines an upwardly facing bearing shoulder surface or ledge 126, 128. A first or front side 130 of clip 114 has a T-shaped locking ratchet support member 132 thereon having a first portion defining a first series of unidirectional locking ratchets 134 which extend transversely above prongs 118, 120 substantially entirely the full width of the clip 114 essentially as depicted in FIGS. 13 and 14. T-shaped locking ratchet support member 132 has a further portion extending downwardly to define a second series of unidirectional ratchet teeth 136 which extend transversely between prongs 118, 120. Thus, the first series of locking ratchets 134 has a transverse extent greater then the transverse extent of the second series of locking ratchets 136. On the second or opposed side 138 of clip 114, proximal to central depressor portion 116, is a camming ramp 140 substantially as shown in FIG. 11, the purpose of which will be described more fully below.

As in the prior embodiment of FIGS. 1-8, locking head and strap support 120 includes a pair of parallel substantially parallel strap reception channels 54, 56, and first and second locking ratchet support members 46 and 50, each carrying respective unidirectional locking ratchets 48 and 52. Locking head and strap support 112 has a front wall 142, a back wall 144, a first side wall 146, and a second side wall 148. Front and back walls 142, 144 furthermore include pairs of longitudinally spaced axially aligned through openings proximal to the inside surface of each opposed first and second side wall 146, 148, respectively. Thus, with reference to FIGS. 9 and 11-14, a first pair of through openings 150, 152 is provided in front wall 142 in axial alignment with a second pair of through openings 154, 156 provided in back wall 144. Similarly, a third pair of through openings 158, 160, is provided in front wall 142 in axial alignment with a fourth pair of through openings 162, 164 provided in back wall 144.

In accordance with the present invention, axially aligned through holes or openings 150, 154 are adapted to locate and capture locking clip or member 114 in a first "non-locking" location in strap reception channel 54; axially aligned through openings 152, 156 are adapted to locate and capture locking clip 114 in a second or "locking" condition in strap reception channel 54; axially aligned through openings 158, 162 are adapted to locate and capture locking clip or member 114 in a first "non-locking" location in strap reception channel 56; and axially aligned through openings 1160, 164 are adapted to locate and capture locking clip 114 in a second or "locking" condition in strap reception channel 56.

More specifically, each locking clip 114 is adapted to be supported in either a "locking" or "non-locking" condition inside its respective strap reception channel 54 and 56 by the engagement of the distal outwardly extending barbs 122, 124, on clip prongs 118, 120, respectively, in a corresponding pair of opposed, axially aligned openings in front wall 142 and back wall 144, respectively. Such engagement is characterized by abutting contact between the upwardly facing bearing shoulder surface or ledge 126, 128 of each barb and the corresponding upper wall surface or ceiling defined by each through opening respectively (FIGS. 13, 14).

Deployment of the alternatively preferred embodiment of FIGS. 9-14 is essentially the same as in the previous embodiment of FIGS. 1-8, but for the additional step of activating the locking clip 114 after the ends of the first handcuff strap 14 and the second handcuff strap 24 are pulled away from the combination locking head and strap support 112 such that the first handcuff strap 14 and the second handcuff strap 24 are tight around the respective wrists encircled therein (e.g. see FIG. 8). When this is done, the locking clip 114 appears and is in the "non-locking" position substantially as depicted in FIGS. 9-11 and 13. Next each locking clip is slidingly moved from the "non-locking" condition to the "locking" condition by depressing depressor portion 116 on the upper or top portion of the clip sufficiently to move the entire clip downwardly into its respective strap reception channel as schematically by arrows 170 in FIG. 12 (see also FIGS. 13-14). Such movement continues until the barbs on the prongs of the clip enter and engage openings 152, 156 and 160, 164 on the front and back walls 142, and 144, respectively, in a "snap-fit" manner thereby re-engaging those walls by being captured in their subsequent through openings.

It will be appreciated that because the barbs have angled surfaces, and the prongs are somewhat flexible, relatively light downward pressure on the locking clip depressor portion facilitates release of engagement from the top row of through openings (non-locking) 150, 154, 158, 162 and "snap-fit" re-engagement in the bottom row of through openings (locking) 152, 156, 160, 164, as viewed in the drawings. It will also be appreciated that as a result of the camming action of camming ramp 140, the T-shaped locking ratchet support member 132 and the ratchets thereon are urged toward and into locking engagement with corresponding unidirectional ratchet teeth on each strap received in each strap reception channel as best viewed in FIG. 12. In this "locking" position, it is noted that the bottom portion of the T-shaped locking ratchet support member 132 (second series of unidirectional locking ratchets 136 extending transversely between prongs 118, 120) on each clip comes into abutting contact against the top portion of locking ratchet support members 46 and 50 respectively (FIGS. 12, 14) and remains locked in place in that position when the barbs on the prongs of each clip are "snap fit" engaged in their subsequent bottom row of wall openings, respectively. By this action, not only are the unidirectional locking ratchets on each ratchet support member 46 and 50 engaging corresponding unidirectional locking ratchets on each strap 20, 22, but additionally, the first series of unidirectional locking ratchets 134 which extend transversely above prongs 118, 120 substantially entirely the full width of the clip 114, and the second series of unidirectional locking ratchets 136 on the T-shaped ratchet teeth support member 132, also are engaging corresponding additional teeth on each strap, respectively. This unique alternatively preferred arrangement thus renders the handcuff apparatus of the present invention even more pick-proof than heretofore believed possible because in the "locking condition" afforded by the depressible, movable clip 114, the total number of unidirectional locking ratchets on the alternatively preferred locking head and strap support (with such clip) engaging each strap is increased dramatically.

In using the alternatively preferred embodiment of FIGS. 9-14, it is preferred that locking clip 114 be fabricated from a material that is somewhat harder and tougher than the thermoplastic material used to mold the straps and the combined locking head and strap support. A suitable material meeting this desideratum is a polyamide (Nylon), and such material is particularly preferred. Finally, it may be desirable to provide a signalling device on the outwardly facing surface of each clip to indicate it is in the non-locking condition. Such a signalling device may be a colored dot 168 on the clip's surface proximal to depressor portion 116 (FIG. 10) and which is clearly visible when the clip is in the raised or "non-locking" condition, but which is not visible when the clip is depressed and in the locking condition (FIGS. 12 and 14). Finally, if desired, a series of molded rounded projections or ridges 172 may be formed (molded) on side walls 146 and 148 to enhance the grip-ability of the combined locking head and strap support substantially as depicted in FIGS. 9-12.

Embodiments of the handcuff apparatus 10 can be color-coded with respect to different degrees of danger or other factors to be taken into consideration with respect to the restrained person. For example, one embodiment of the handcuff apparatus 10 can be color-coded black for tactical/outdoor field arrest includes the military. With this embodiment, a UV inhibitor may be present in the handcuff apparatus 10.

Another color-coded embodiment can be colored white for the general population, has low risk. Still another color-coded embodiment can be colored orange to indicate medium risk. Yet another color-coded embodiment can be colored yellow to indicate high risk. Yet another color-coded embodiment can be colored red to indicate extremely dangerous. Still another color-coded embodiment can be colored blue for training purposes. Another color-coded embodiment can be colored pink for gender or miscellaneous purposes.

The components of the handcuff apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved handcuff apparatus that is low in cost, relatively simple in design and operation, and in which the handcuff apparatus provides the handcuffing straps and the locking head are made as a unified, integrated structure. With the invention, a handcuff apparatus is provided in which both the handcuffing straps and the locking head are made from the same material. With the invention, a handcuff apparatus is provided with which only one hand of the person applying the handcuff apparatus need be used. With the invention, a handcuff apparatus is provided which has locking teeth on the handcuff straps which do not contact the restrained person's skin. With the invention, a handcuff apparatus is provided in which handcuff straps in a storage mode are ready to be deployed with a one-hand operation without removing free ends of the handcuff straps from the locking head. With the invention, a handcuff apparatus is provided which does not include handcuff straps that have end pieces with strap-reception channels therethrough. With the invention, a movable or slidable locking clip optionally is provided to enhance the inability of the handcuff apparatus to be picked after being deployed on a person being restrained.

With the invention, a handcuff apparatus is provided which does not require an interlocking cover to connect together two separate and distinct combined strap support and locking head units. With the invention, a handcuff apparatus is provided which is difficult to pick and unlock. With the invention, a handcuff apparatus is provided which can be easily folded up for a storage mode and can be easily unfolded for deployment. With the invention, a handcuff apparatus is provided which is made from a material which provides maximum tensile strength having minimal flex modulus so that the handcuff straps can be easily folded. With the invention, a handcuff apparatus is provided which has a large flat writing surface which allows for coding and identification of the restrained person. With the invention, a handcuff apparatus is provided which can be made in different color versions that can be color-coded with respect to the degree of danger or other factors to be taken into consideration with respect to the restrained person.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A handcuff apparatus, comprising:

a combination locking head and strap support, a first handcuff strap and a second handcuff strap connected to said combination locking head and strap support, wherein both said first handcuff strap and said second handcuff strap extend outward from said combination locking head and strap support from the same side of said combination locking head and strap support, wherein said first handcuff strap includes a first ratchet-bearing side and a first smooth side, wherein first strap-supported unidirectional ratchet members are located on said first ratchet-bearing side, and wherein said second handcuff strap includes a second ratchet-bearing side and a second smooth side, wherein second strap-supported unidirectional ratchet members are located on said second ratchet-bearing side, a first strap reception channel which receives a free end portion of said first handcuff strap, a first locking ratchet support member extending into said first strap reception channel, and first unidirectional locking ratchets supported by said first locking ratchet support member, wherein said first unidirectional locking ratchets engage said first strap-supported unidirectional ratchet members, a second strap reception channel which receives a free end portion of said second handcuff strap, a second locking ratchet support member extending into said second strap reception channel, and second unidirectional locking ratchets supported by said second locking ratchet support member, wherein said second unidirectional locking ratchets engage said second strap-supported unidirectional ratchet members, said apparatus further including:

a manually activatable locking member located in at least one of said first or said second strap reception channels, said manually activatable locking member being slidably movable between a first non-locking position and a second locking position, said manually activatable locking member having third unidirectional locking ratchets adapted to engage either said first or second handcuff strap supported unidirectional ratchet members only in said locking condition.

2. The apparatus of claim 1 wherein either said first ratchet-bearing side or said second ratchet-bearing side includes a smooth identification reception region.

3. The apparatus of claim 1 wherein:

said first handcuff strap includes a first proximal folding crease and a first distal folding crease located on said first smooth side and includes a first intermediate folding crease located on said first ratchet-bearing side, and said second handcuff strap includes a second proximal folding crease and a second distal folding crease located on said second smooth side and includes a second intermediate folding crease located on said second ratchet-bearing side.

4. The apparatus of claim 1 wherein said manually activatable locking member has a camming ramp, said manually activatable locking member being adapted to be moved from a non-locking position in its corresponding strap reception channel to a locking position in said strap reception channel, and wherein said cam causes said third unidirectional locking ratchets to engage said first or second handcuff strap received in said channel when said manually activatable member is slidingly moved within said channel between a first non-locking position and a second locking position.

5. The apparatus of claim 4 wherein said combination locking head and strap support includes first capturing means for retaining said manually activatable locking member in said second locking position.

6. The apparatus of claim 5 wherein said manually activatable locking member includes a pair of prongs, said prongs terminating distally in first and second a barbs respectively, said combination locking head and strap support having first and second walls defining said strap reception channel, and wherein said first capture means comprises a first pair of openings in said walls for receiving said barbs, respectively, when said manually activatable locking member is moved into said locking position within said channel.

7. The apparatus of claim 4 wherein said combination locking head and strap support includes second capturing means for retaining said manually activatable locking member in said first non-locking position.

8. The apparatus of claim 6 wherein said manually activatable locking member includes a pair of prongs, said prongs terminating distally in first and second a barbs respectively, said combination locking head and strap support having first and second walls defining said strap reception channel, and wherein said second capture means comprises a second pair of openings in said walls for receiving said barbs, respectively, when said manually activatable locking member is in said non-locking position within said channel.

9. The apparatus of claim 4 wherein said manually activatable locking member further includes signal means for indicating when said manually activatable locking member is in the non-locking position.

10. The apparatus of claim 1 wherein free ends of said first handcuff strap and said second handcuff strap are connected together by a rivet assembly.

* * * * *